US005503216A

United States Patent [19]

Streubel

[11] Patent Number: 5,503,216

[45] Date of Patent: Apr. 2, 1996

[54] CONTINUOUS CASTING MOLD FOR THE CASTING OF THIN SLABS

[75] Inventor: Hans Streubel, Erkrath, Germany

[73] Assignee: SMS Schloemann-Siemag Aktiengesellschaft, Dusseldorf, Germany

[21] Appl. No.: 272,199

[22] Filed: Jul. 8, 1994

[30] Foreign Application Priority Data

Jul. 9, 1993 [DE] Germany ..... 43 22 948.4

[51] Int. Cl.[6] ..... B22D 11/124

[52] U.S. Cl. ..... 164/418; 164/443

[58] Field of Search ..... 164/485, 418, 164/459, 443, 122, 125, 348

[56] References Cited

U.S. PATENT DOCUMENTS 3,520,352 7/1970 Hess ..... 164/485
4,023,612 3/1977 Jackson ..... 164/495

*Primary Examiner*—P. Austin Bradley
*Assistant Examiner*—Randy Herrick
*Attorney, Agent, or Firm*—Herbert Dubno

[57] ABSTRACT

In a continuous casting mold, the adjustable cooled narrow walls between the broad walls for continuous casting of thin slabs are divided into upper slab-shaping and lower supporting parts. At the lower parts, gaps are provided at the edges of the slab to reduce cooling and thereby prevent the formation of edge cracks on the solidifying slab.

10 Claims, 4 Drawing Sheets

CONTINUOUS CASTING MOLD FOR THE CASTING OF THIN SLABS

FIELD OF THE INVENTION

The present invention relates to a continuous casting mold for the casting of thin slabs, generally of steel, and, more particularly, to a continuous casting mold of the type which has a pair of cooled broad sidewalls and, between the latter, adjustable cooled narrow sidewalls which are formed with an upper shaping part and a lower support part.

BACKGROUND OF THE INVENTION

Continuous casting molds of this type are described, for example, in German Patent Document DE-A1 4 131 829 and can comprise the cooled broad sidewalls and narrow side walls. The upper shaping parts of these narrow walls and broad walls abut respective upper portion of the slab's opposite side walls until the slab reaches the outlet of the ingot mold where support parts are provided. The support parts are closed by a starting head for start up of the continuous casting operation.

The adjustability of the narrow sidewalls allows the desired width of the thin slab to be set.

This type of mold has the drawback that, especially at high casting speeds, there is a danger of crack development at the edges of the thin slab. Such cracks can lead to a reduction in the quality of rolled products resulting from the rolling of the continuously cast slab.

In German Patent Document DE-A2 1 906 261, which refers to billet molds, some 300 to 500 mm below the level of the melt gaps are provided at the corners of the mold walls and these corner gaps are covered with heat insulating wall plates. The resulting mold is expensive and a sealing at the end by a starting head is exceptionally difficult. Changes in the size of the billets which are to be produced is rendered difficult because of a rigid interconnection of the walls. The heat insulation of the corners is disadvantageous for high speed casting of thin slabs.

OBJECTS OF THE INVENTION

It is, therefore, the principal object of the present invention to provide a continuous casting mold for the afore-described purposes, i.e. for the continuous casting of thin slabs, whereby without diminution of shape stability, edge cracking can be avoided in a simple manner.

Another object of this invention is to provide a continuous casting mold for the purposes described which avoids the edge cracking as previously noted but nevertheless allows adjustability of the narrow sidewalls for change in the width of the thin slab which is produced by continuous casting and allows sealing of the lower end of the mold by a starting head for startup of the continuous casting process.

Still another object of this invention is to provide an improved continuous casting mold whereby drawbacks of earlier systems are obviated.

SUMMARY OF THE INVENTION

These objects are attained, in accordance with the invention by providing the narrow sidewalls with their upper slab-shaping parts and lower slab support parts so that on the inner or working side, these parts have different edge strips and the edge strips in the support part are set back outwardly relatively to the edge strips of the shaping parts.

By this formation of spaces or gaps between the narrow sides of the continuous casting and the side strips of the narrow sidewalls, at the support parts, an excessive cooling of the edges of the continuous casting can be avoided and crack formation can be excluded. A sealing of the mold by the starting head at the lower end of the mold is possible without difficulty, adjustability of the narrow walls for slab sizing is ensured and even an adjustment of the taper of the walls of the mold is possible.

According to a feature of the invention, the working side of each narrow side working wall has a planar upper portion and a lower portion including edge strips and a central strips. The edge strips are recessed from the plane of the upper portion. Alternatively the lower portions are planar and the upper portion has inwardly projecting formations constituting the edge strips. The width of the edge strips should be a maximum of 15 mm and, when the edge strips of the lower portion are recesses from the plane of the upper portion, the length of the edge strips of the lower portion should be a maximum of 400 mm.

In the alternative configuration, where the upper edge strips project inwardly, they should have lengths of at least 400 mm.

More specifically, a continuous casting mold for the continuous casting of thin slabs can comprise:

a pair of generally upright fluid-cooled spacedly juxtaposed broad walls along which broad sides of a continuously cast slab is formed; and a pair of fluid-cooled narrow walls between the broad walls and along which narrow sides of the continuously cast slab is formed, the narrow walls being adjustable toward and away from one another between the broad walls, each of the narrow walls comprising:

an upper slab-shaping part and a lower support part, different side strips along the parts of each slab-engaging side of each narrow wall, the side strips of each support part being set back outwardly from the side strips of the respective slab-shaping part.

In one alternative the slab-engaging side of each of the narrow walls is planar at the upper slab-shaping part thereof and the side strips of the lower support part thereof are set back outwardly from the plane of the slab-engaging side of the respective upper part.

In the other alternative the slab-engaging side of each of the narrow walls is planar at the lower support part thereof and the side strips of the upper slab-shaping part thereof project inwardly beyond the plane of the slab-engaging side of the respective lower part.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
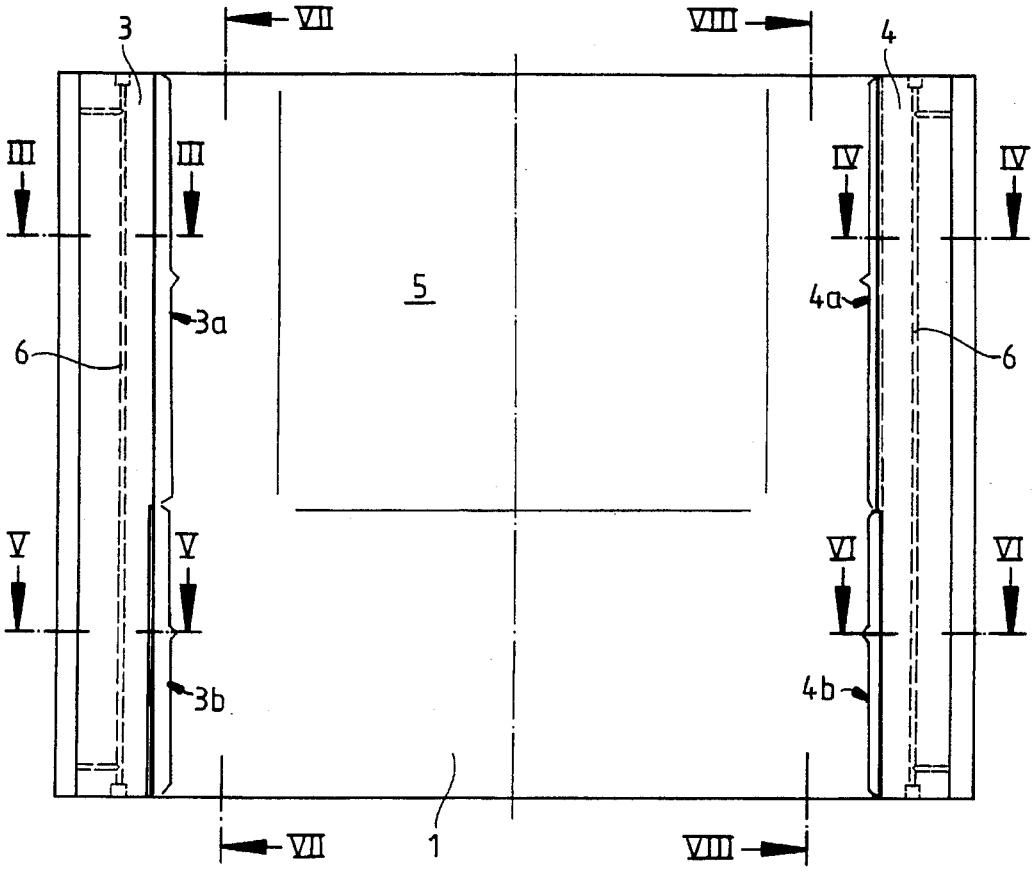
FIG. 1 is a highly diagrammatic elevational view of a continuous casting mold of the invention, one of whose broad sidewalls have been removed.
Figure 2:
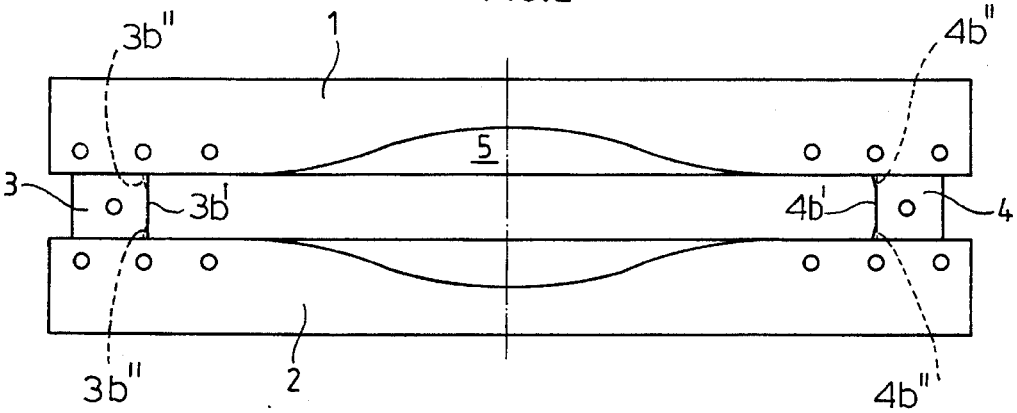
FIG. 2 is a highly diagrammatic top plan view of the mold of FIG. 1.
Figure 1A:
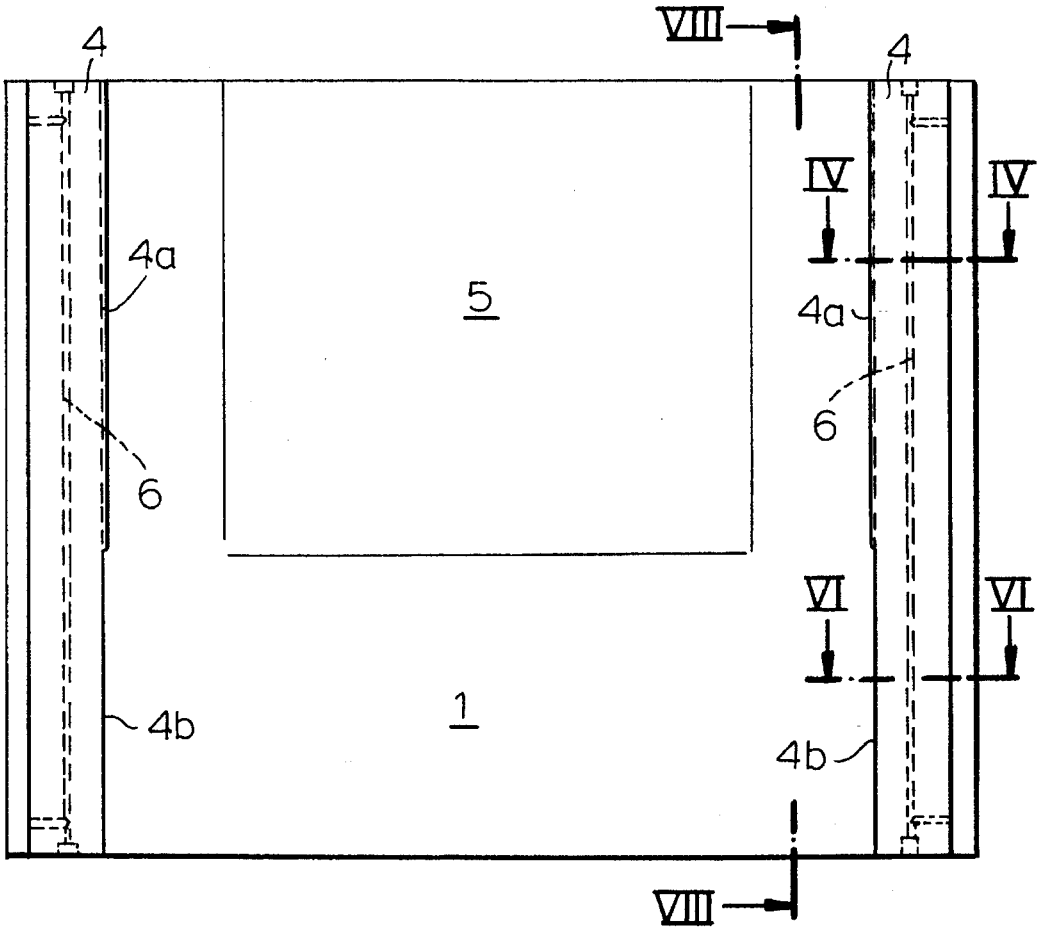
FIG. 1A is a view similar to FIG. 1 of an alternative construction.
Figure 2A:
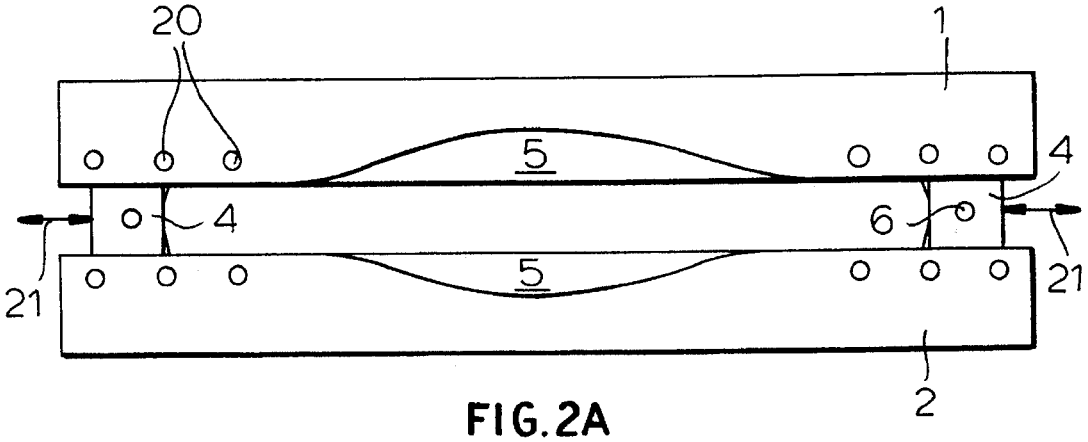
FIG. 2A is a top plan view similar to FIG. 2 of the alternative construction.

As can be seen from FIGS. 1 and 2 on the one hand and FIGS. 1A and 2A on the other, a mold for the continuous casting of thin slabs can comprise two broad sidewalls 1 and 2, which may be provided with passages 20 through which water can be circulated as a cooling fluid, and, between these broad sidewalls, adjustable small sidewalls 3 or 4. The adjustability of the small sidewalls is represented by the arrows 21 in FIGS. 2 and 2A and is used to adjust the width of the thin slabs which are produced.

The broad sidewalls 1 and 2 are upwardly and inwardly recessed in a concavely curved region 5 to form an enlarged pouring space into which the molten metal can be fed from a tundish or the like. The small sidewalls 3 are also provided with cooling water passages 6.

Figure 3:
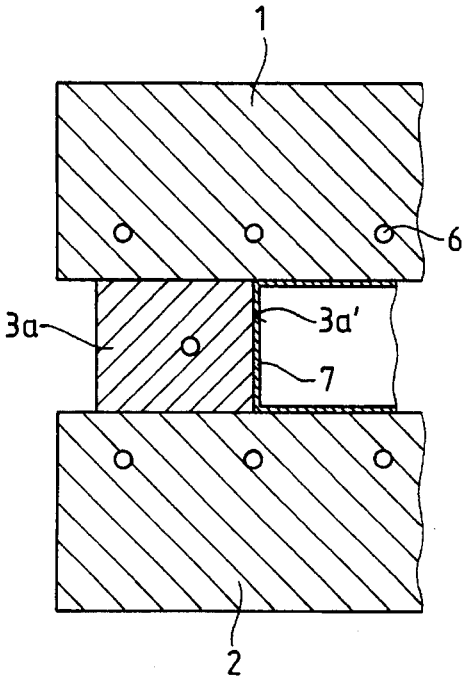
FIG. 3 is an enlarged cross sectional view taken along line III—III of FIG. 1.
Figure 4:
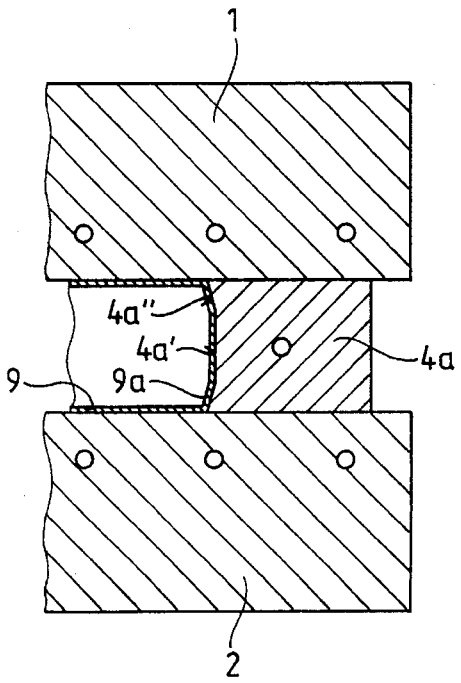
FIG. 4 is a cross sectional view taken along line IV—IV of FIG. 1A illustrating a portion of the mold corresponding to that shown in FIG. 3.
Figure 5:
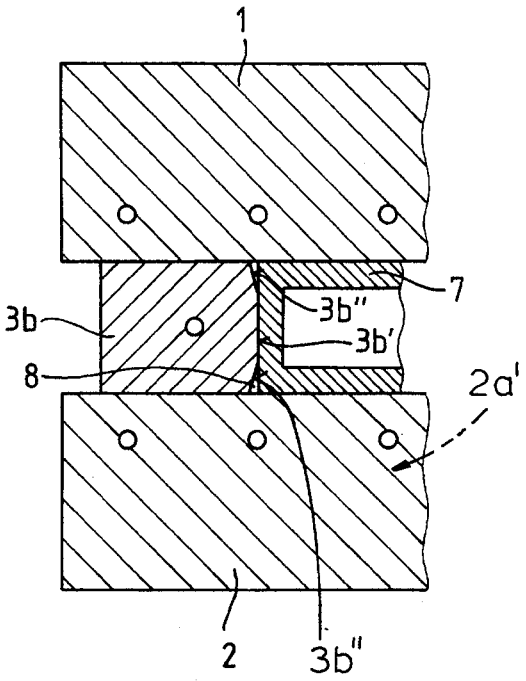
FIG. 5 is an enlarged cross sectional view taken along the line V—V of FIG. 1.
Figure 6:
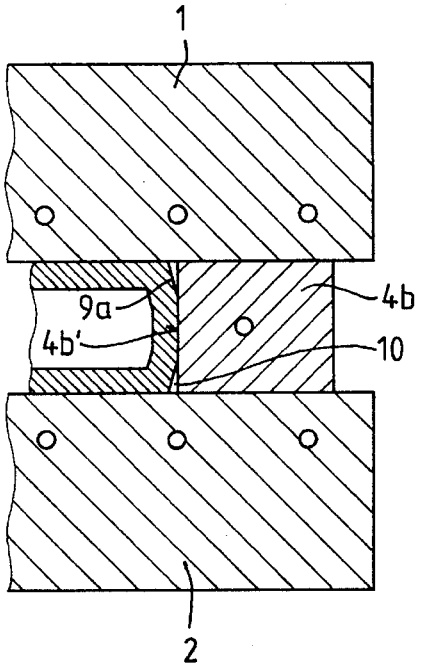
FIG. 6 is a cross sectional view taken along line VI—VI of FIG. 1A and showing that cross section at a location corresponding to the view of FIG. 5.
Figure 7:
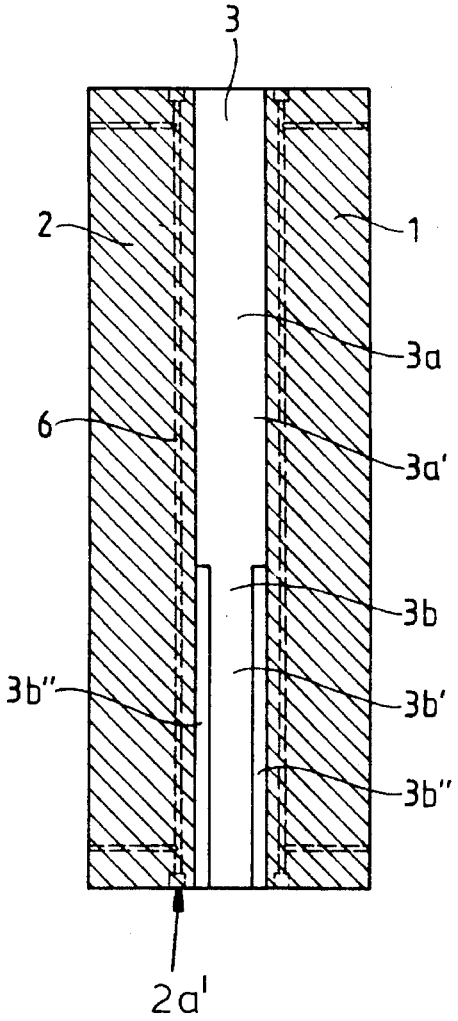
FIG. 7 is a longitudinal section taken along the line VII—VII of FIG. 1.
Figure 8:
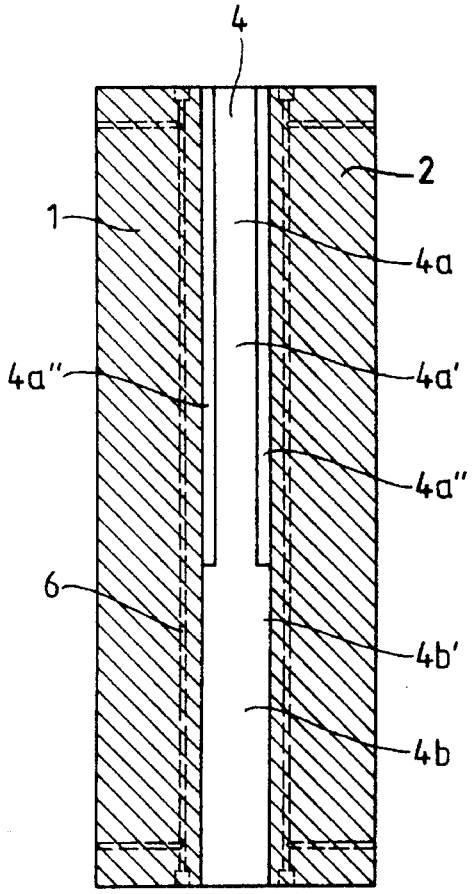
FIG. 8 is a corresponding longitudinal section taken along the line VIII—VIII of FIG. 1A.

The configuration of the narrow sidewalls 3 of FIG. 1 will be apparent from FIGS. 3, 5 and 7 showing cross sectional views. From these figures it will be apparent that the narrow sidewalls 3 comprise upper parts 3*a* with planar working surfaces 3*a'* and lower parts 3*b*. The upper part is a slab-shaping part and the lower part supports the slab.

In the lower part 3*b*, a central strip 3*b'* is flush with the planar surface 3*a'*. Two side strips 3*b"*, however, are recessed outwardly relative to the central strip 3*b'*. The width of these side strips is advantageously less than 15 mm.

With this construction it is apparent that in the upper part of the mold corresponding to the parts 3*a* of the sidewalls, a rectangular continuous cast shell 7 is solidified against the walls 1, 2, (3*a'*) which progressively thickens as it moves downwardly and by the lower segment 3*b* has self supporting edges.

Because of the set back side strips 3*b"*, in this region gaps 8 are formed which reduce the cooling effect at the corners of the cross section of the slab and thus avoid the formation of edge cracks in the continuous casting.

An alternative configuration is represented in FIGS. 1*a*, 2*a*, 4, 6 and 8.

Here the narrow sidewall 4 has an upper segment 4*a* and a lower segment 4*b*. The upper segments 4*a* have central strips 4*a'* and two inwardly projecting side strips 4*a"*. The lower segment 4*b* has a planar surface 4*b'* which is flush with the central strip 4*a'* of the upper part.

The continuous casting 9 which is formed in the upper part of the mold (FIG. 4) solidifies against the side strip 4*a'*, 4*a"*, each of a width of at most 15 millimeters so that the corners of the slab cross section are set back or bevelled at 9*a*. As the casting passes downwardly, gaps 10 are formed when the edges of the casting reach the surface 4*b'* of the lower segment. These gaps reduce the cooling and crack formation at the edges of the cast formation.

I claim:

1. A continuous-casting mold for the continuous casting of thin slabs, the mold comprising:

a pair of generally upright fluid-cooled spacedly juxtaposed broad walls along which broad sides of a continuously cast slab are formed; and a pair of generally upright fluid-cooled narrow walls between said broad walls and along which narrow sides of said continuously cast slab are formed, said narrow walls being adjustable toward and away from one another between said broad walls, each of said narrow walls comprising an upper slab-shaping part extending downward and terminating at a distance from a respective bottom of the narrow wall and a lower support part extending downward from the upper slab-shaping part to the bottom, each of said lower support parts in turn being formed by a vertically extending central strip and a pair of vertically extending flanking side strips, the side strips of each support part being set back outward from the respective slab-shaping part.

2. The continuous-casting mold defined in claim 1 wherein each of said side strips has a width of a maximum of 15 mm.

3. The continuous-casting mold defined in claim 1 wherein said side strips of said lower parts are recessed outward from said upper parts and have a length of a maximum of 400 mm.

4. The continuous-casting mold defined in claim 1 wherein each of said upper slab-shaping parts is planar and the side strips of the lower support parts are set back outward from the plane of the respective upper slab-shaping parts.

5. The continuous-casting mold defined in claim 4 wherein said side strips of said lower parts have a maximum length of 400 mm.

6. A continuous-casting mold for the continuous casting of thin slabs, the mold comprising:

a pair of generally upright fluid-cooled spacedly juxtaposed broad walls along which broad sides of a continuously cast slab are formed; and a pair of generally upright fluid-cooled narrow walls between said broad walls and along which narrow sides of said continuously cast slab are formed, said narrow walls being adjustable toward and away from one another between said broad walls, each of said narrow walls comprising an upper slab-shaping part extending downward and terminating at a distance from a respective bottom of the narrow wall and a lower support part extending downward from the upper slab-shaping part to the bottom, each of said upper slab-forming parts in turn being formed by a vertically extending central strip and a pair of vertically extending flanking side strips, the side strips of each upper slab-forming part being set inward from the respective lower support part.

7. The continuous-casting mold defined in claim 6 wherein each of said side strips has a width of a maximum of 15 mm.

8. The continuous-casting mold defined in claim 6 wherein said side strips of said upper parts project inward of said lower parts and have lengths of at least 400 mm.

9. The continuous-casting mold defined in claim 2 wherein each of said lower support parts is planar and the side strips of the upper slab-shaping parts are set inward from the plane of the respective lower support parts.

10. The continuous-casting mold defined in claim 9 wherein said side strips of said upper slab-shaping parts have a maximum length of 400 mm.

* * * * *